US010384452B2

(12) United States Patent
Nishikawa

(10) Patent No.: US 10,384,452 B2
(45) Date of Patent: Aug. 20, 2019

(54) LIQUID EJECTION APPARATUS

(71) Applicant: BROTHER KOGYO KABUSHIKI KAISHA, Nagoya-shi, Aichi-ken (JP)

(72) Inventor: Yasuo Nishikawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/837,526

(22) Filed: Dec. 11, 2017

(65) Prior Publication Data

US 2018/0178519 A1 Jun. 28, 2018

(30) Foreign Application Priority Data

Dec. 28, 2016 (JP) ..... 2016-256499

(51) Int. Cl.
*B41J 2/165* (2006.01)
*B05B 14/00* (2018.01)

(52) U.S. Cl.
CPC ..... *B41J 2/16505* (2013.01); *B05B 14/00* (2018.02); *B41J 2/16508* (2013.01); *B41J 2/16523* (2013.01)

(58) Field of Classification Search
None
See application file for complete search history.

(56) References Cited

U.S. PATENT DOCUMENTS

2016/0103414 A1* 4/2016 Ohnishi ..... B41J 2/16508 347/1

FOREIGN PATENT DOCUMENTS

JP 2003-11394 A 1/2003
JP 2013-147039 A 8/2013

* cited by examiner

*Primary Examiner* — Matthew Luu
*Assistant Examiner* — Tracey M McMillion
(74) *Attorney, Agent, or Firm* — Merchant & Gould P.C.

(57) ABSTRACT

A first waste liquid reservoir disposed in a housing of a liquid ejection apparatus includes a first container, and a first retainer disposed in the first container to retain the liquid conveyed through a passage member. A second waste liquid reservoir disposed in the housing includes a second container, and a second retainer disposed in the second container so as to be in contact with the first retainer. The second retainer retains the liquid conveyed through the passage member. The second waste liquid reservoir is movable in a first direction, and one of the first waste liquid reservoir and the second waste liquid reservoir is movable in a second direction perpendicular to the first direction. At least one of the first retainer and the second retainer protrudes in the second direction from corresponding at least one of the first container and the second container.

13 Claims, 11 Drawing Sheets

LIQUID EJECTION APPARATUS

CROSS-REFERENCE TO RELATED APPLICATION

This application claims priority from Japanese Patent Application No. 2016-256499 filed on Dec. 28, 2016, the content of which is incorporated herein by reference in its entirety.

FIELD OF DISCLOSURE

Aspects disclosed herein relates to a liquid ejection apparatus including a waste liquid reservoir configured to retain therein liquid discharged from a head.

BACKGROUND

A known liquid ejection apparatus includes a head configured to eject ink from nozzles onto a sheet to thereby record an image on the sheet, a pump configured to draw ink from the nozzles to prevent ink clogging in a passage connected to the nozzles, and a waste liquid reservoir configured to retain ink drawn by the pump.

In response to recent demands for compact design, the waste liquid reservoir includes a fixed waste liquid reservoir fixed to a housing of the apparatus, and a movable waste liquid reservoir removable from the housing. The fixed liquid reservoir includes a fixed waste liquid container and a fixed retainer disposed in the fixed waste liquid container and configured to retain waste liquid discharged from the head. The movable waste liquid reservoir includes a movable waste liquid container and a movable retainer disposed in the movable waste liquid container and configured to retain waste liquid discharged from the head. The fixed waste liquid retainer and the movable waste liquid retainer contact each other when the movable waste liquid reservoir is attached to the housing.

SUMMARY

It may be beneficial to provide a liquid ejection apparatus including a fixed waste liquid retainer and a movable waste liquid retainer which are configured to reliably contact each other to allow smooth conveyance of waste liquid from the fixed waste liquid retainer to the movable waste liquid retainer.

According to one or more aspects of the disclosure, a liquid ejection apparatus comprises a housing, a head configured to eject liquid, a passage member configured to convey therethrough liquid discharged from the head, a first waste liquid reservoir, and a second waste liquid reservoir. The first waste liquid reservoir is disposed in the housing and includes a first container connected to the passage member, and a first retainer having a first contact portion and disposed in the first container. The first retainer is configured to retain the liquid conveyed through the passage member. The second waste liquid reservoir is disposed in the housing and includes a second container, and a second retainer having a second contact portion and disposed in the second container such that the second contact portion is in contact with the first contact portion of the first retainer. The second retainer is configured to retain the liquid conveyed through the passage member. The second waste liquid reservoir is movable in a first direction, and one of the first waste liquid reservoir and the second waste liquid reservoir is movable in a second direction perpendicular to the first direction. At least one of the first retainer and the second retainer protrudes in the second direction from corresponding at least one of the first container and the second container.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, illustrative embodiments of the disclosure will be described with reference to the accompanying drawings.

<Overall Configuration of Multifunction Device>

Figure 1:
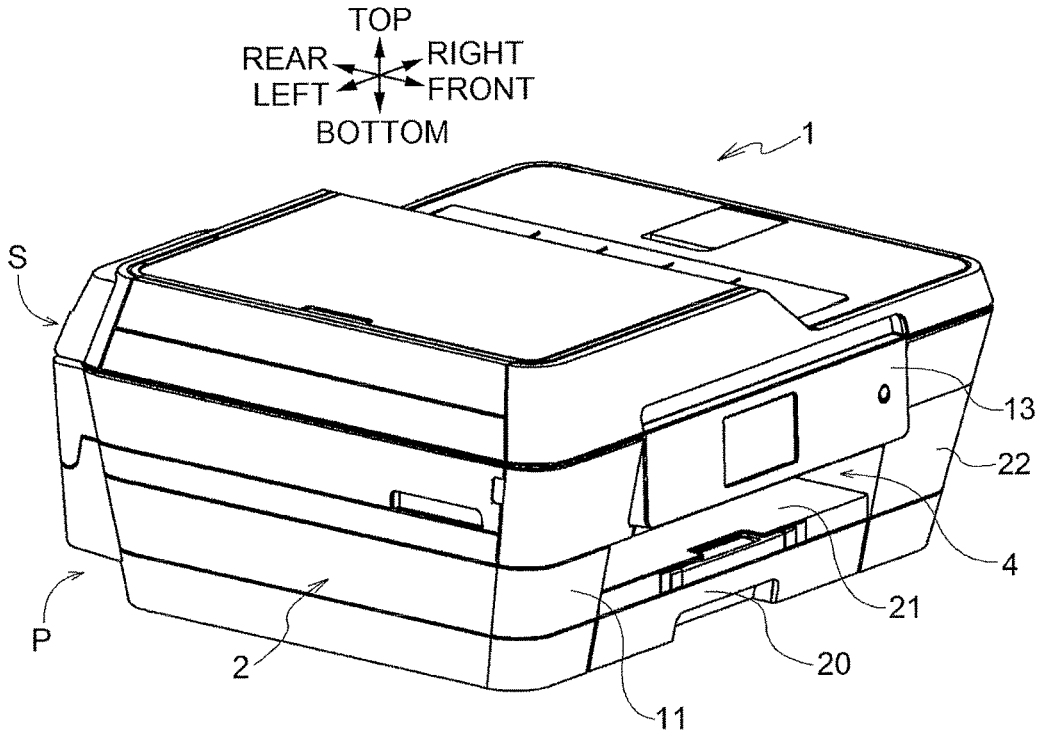
FIG. 1 is a perspective view of a multifunction device including a printer in a first illustrative embodiment according to one or more aspects of the disclosure.

As shown in FIG. 1, according to a first illustrative embodiment, a multifunction device integrally includes a printer P disposed at a lower portion thereof and a scanner C disposed above the printer P. The printer P is an example of a liquid ejection apparatus. The multifunction device has a printing function, a scanning function, a copying function, and a facsimile function. The printer P having the printing function is an inkjet printer.

As illustrated in FIG. 1, a top-bottom direction may be defined with reference to an orientation of the multifunction device 1 that may be disposed in an orientation in which it may be intended to be used. A side of the multifunction device 1, in which a sheet supply/discharge opening 4 may be provided, may be defined as the front of the multifunction device 1. A front-rear direction may be defined with reference to the front of the multifunction device 1. A right-left direction may be defined with respect to the multifunction device 1 as viewed from its front. The directions defined in FIG. 1 may be applicable to all the drawings.

The printer P is configured to print an image on recoding media such as a sheet, based on image data input from external devices, such as a computer, a digital camera, and a USB memory, connected to the multifunction device 1, and image data input from various memory media such as a memory card.

The printer P disposed at a lower portion of the multifunction device 1 includes a substantially rectangular parallelepiped housing 2. The hosing 2 has, at a central portion in the right-left direction of its front face 11, the sheet supply/discharge opening 4. A sheet cassette 20 and a discharge tray 21 are disposed in the sheet supply/discharge opening 4. The sheet cassette 20 is removably inserted from the front face 11 into the sheet supply/discharge opening 4, which is an example of a cassette opening. An operation panel 13 is disposed at the front face 11 and includes various operation buttons and a liquid-crystal display.

Figure 2:
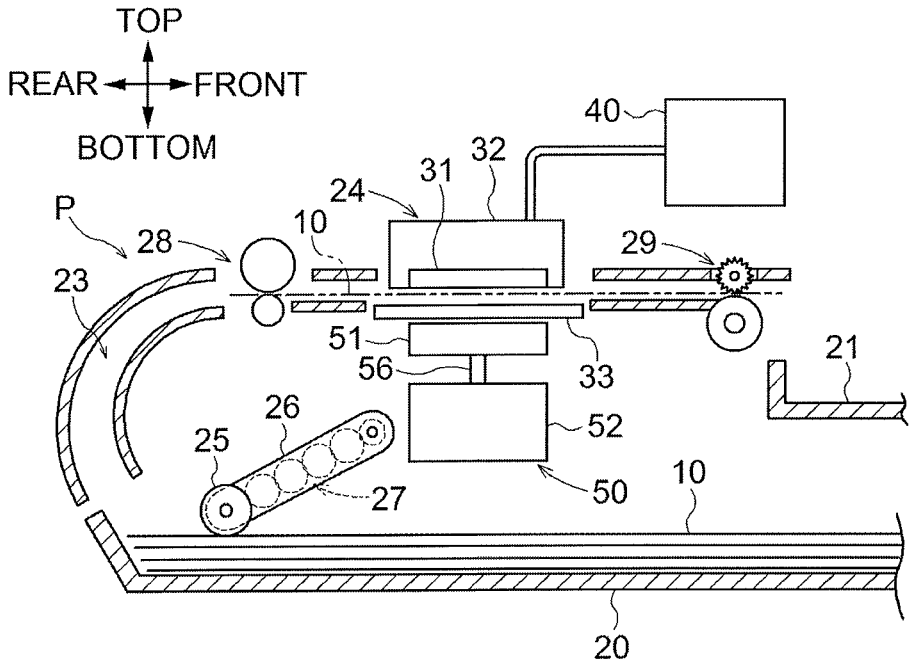
FIG. 2 is a cross-sectional side view of the printer in the first illustrative embodiment.

As shown in FIG. 2, the printer P includes the sheet cassette 20, a feed roller 25, a conveying path 23, a convey roller pair 28, a recording unit 24, a discharge roller pair 29, and the discharge tray 21. The sheet cassette 20 is configured to hold thereon a stack of sheets 10. The feed roller 25 is configured to feed an upper most one of the sheets 10 stacked on the sheet cassette 20 toward the conveying path 23.

The feed roller 25 is rotatably supported by the feed arm 26 and is driven by a motor (not shown) through a drive transmission mechanism 27 such as a gear train. The conveying path 23 is defined to curve upward from a rear end of the sheet cassette 20 and extend straight toward the front of the hosing 2. The conveying path is defined at a substantially center of the housing 2 in the right-left direction. The convey roller pair 28, which is disposed at the conveying path 23, is configured to convey the sheet 10 fed by the feed roller 25.

The recording unit 24, which is disposed downstream of the convey roller pair 28 in a conveying direction, is configured to record an image on the sheet 10 conveyed by the convey roller pair 28 to the recording unit 24. The discharge roller pair 29, which is disposed downstream of the recording unit 24 in the conveying direction, is configured to discharge the sheet 10 having the image recorded thereon onto the discharge tray 21.

The recording unit 24 includes a recording head 31, a carriage 32, and a platen 33. The recording head 31, which is an example of head, is configured to eject ink, which is an example of liquid. The recording head 31 is mounted on the carriage 32 which is disposed above the conveying path 23. A belt drive mechanism (not shown) driven by the above-mentioned motor moves the carriage 32 along a guide rail (not shown) extending in the right-left direction. The platen 33 is disposed below the recording head 31.

The platen 33 extends across a moving zone of the carriage 32 in the right-left direction and is configured to support a lower surface of the sheet 10 being conveyed along the conveying path 23. The recording head 31 faces the platen 33 and is configured, when the carriage 32 moves in the right-left direction, to selectively eject ink onto the sheet 10 supported on the platen 33, thereby recording an image on the sheet 10.

Figure 3:
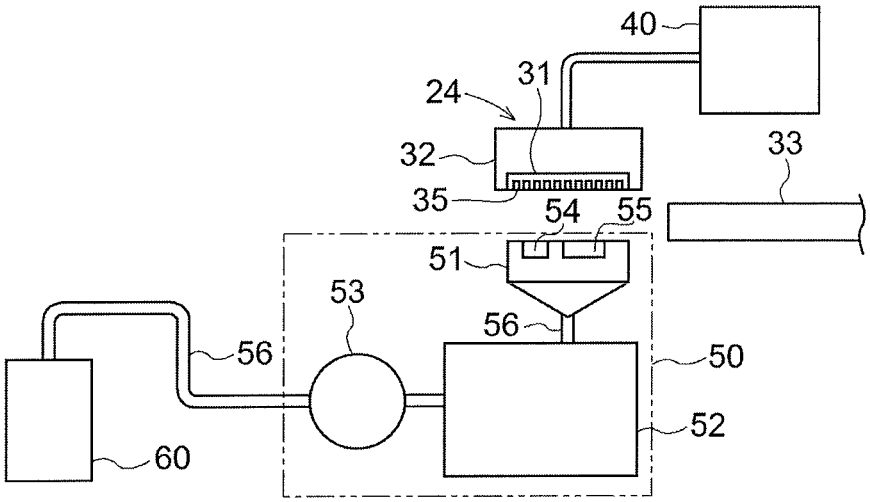
FIG. 3 is a schematic diagram of a maintenance unit and a waste liquid reservoir of the printer in the first illustrative embodiment.

As shown in FIG. 3, a plurality of nozzles 35 are open in a lower surface of the recording head 31. A plurality of arrays of nozzles, e.g., four arrays of nozzles corresponding to cyan, magenta, yellow, and black inks, are arranged in the lower surface of the recording head 31 along a moving direction of the recording head 31.

The multifunction device 1 includes a refill unit 40 including ink cartridges which store inks of corresponding colors. Each ink cartridge is fluidly connected to the recording head 31.

The multifunction device 1 includes a maintenance unit 50 configured to draw ink from the nozzles 35 of the recording head 31. The maintenance unit 50 includes a movable unit 51, a cam mechanism 52 configured to move the movable unit 51 in the top-bottom direction, a pump 53, caps 54, 55 disposed at the movable unit 51, and a tube 56. The tube 56 is an example of a passage member through which ink discharged from the recording head 31 is conveyed.

The caps 44, 45, which may be made of an elastic material such as rubber, are disposed so as to face the lower surface of the recording head 31 in the top-bottom direction when the carriage 32 is located right above the movable unit 51. The cam mechanism 52 is driven by the above-mentioned motor to move the movable unit 51 in the top-bottom direction. The caps 54, 55 contacts the lower surface of the recording head 31 when the movable member 51 moves up, and leaves away from the lower surface of the recording head 31 when the movable member 51 moves down.

The caps 44, 45 respectively cover an array of the nozzles 35 for ejecting a black ink and arrays of the nozzles 35 for ejecting cyan, magenta, and yellow inks. The caps 54, 55 in contact with the lower surface of the recording head 31 define enclosed spaces. One end of the tube 56 is connected to each of the caps 54, 55. The tube 56 may be, for example, a flexible resin member.

The pump 53 may be a rotary tube pump which is driven by a motor (not shown). When the caps 54, 55 are in contact with the lower surface of the recording head 31, the pump 54 is in fluid communication with the spaces enclosed by the caps 54, 55 and the lower surface of the recording head 31.

When the pump 53 is driven in a state where the caps 54, 55 contacts the lower surface of the recording head 31 to cover the nozzles 35, the spaces enclosed by the caps 54, 55 become lower in pressure than the atmospheric pressure. This causes ink to be discharged from the nozzles 35. The caps 54, 55 receive the ink discharged from the nozzles 35. The pump is actuated to convey the ink received by the caps 54, 55, through the tube 56, into a waste liquid reservoir 60 to which the other end of the tube 56 is connected.

Figure 4:
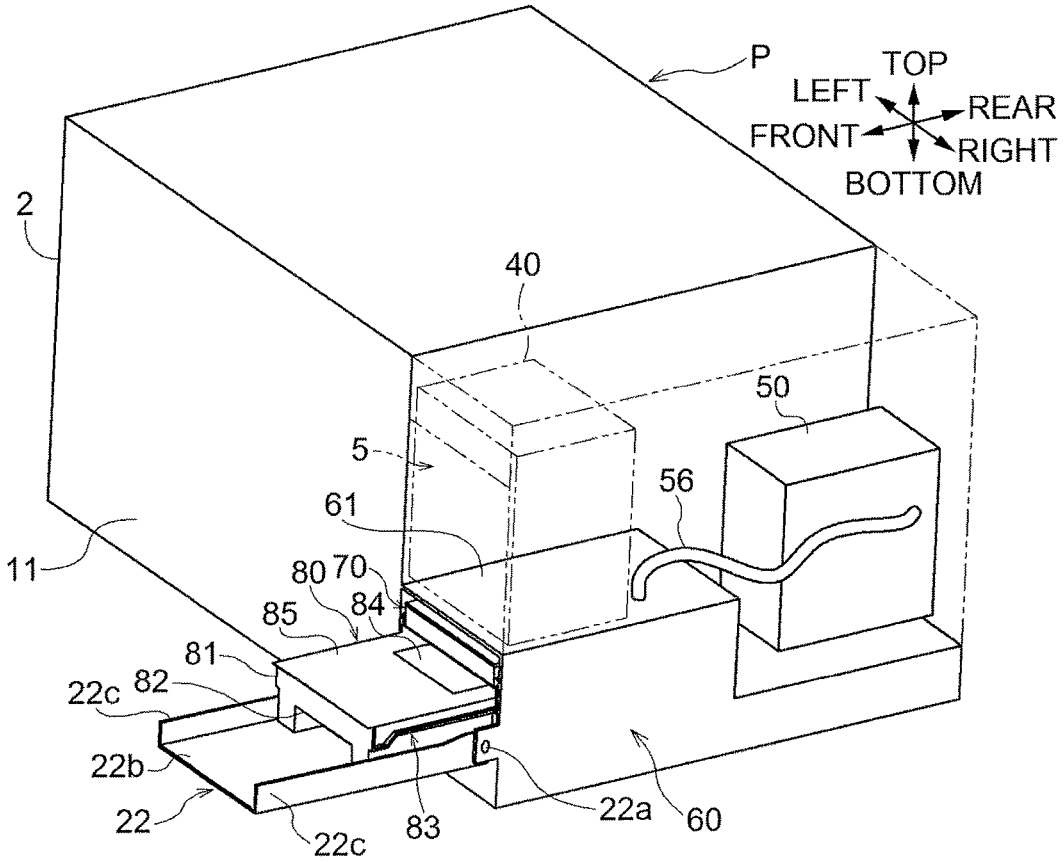
FIG. 4 is a perspective view of the waste liquid reservoir, the maintenance unit, and a refill unit which are disposed in a housing of the printer in the first illustrative embodiment.

As shown in FIG. 4, the maintenance unit 50 is disposed at a rear right end portion of the housing 2, and the waste liquid reservoir 60 is disposed in front of the maintenance unit 50. The waste liquid reservoir 60 is disposed at a front right end portion of the housing 2. The refill unit 40 for accommodating therein ink cartridges, each of which is an example of a liquid cartridge, is disposed above the waste liquid reservoir 60.

A replacement opening 5 is open at a right end portion of the front face 11 of the housing 2. The housing 2 includes a cover 22 to open and close the replacement opening 5. The cover 22 is pivotable about a pivot axis 22*a* between a closed position at which the cover 22 closes the replacement opening 5 and an open position at which the cover 22 opens the replacement opening 5.

The cover 22 includes an openable plate 22*b* and an extending portion 22. When the cover 22 is at the closed position, the openable plate 22*b* closes the replacement opening 5, and the extending portion 22 extends rearward from right and left ends of the openable plate 22*b*. When the cover 22 is at the open position, the extending portion 22 extends upward from the openable plate 22*b*. When the cover 22 is at the open position, the replacement opening 5 allows therethrough ink cartridges to be inserted into and removed from the refill unit 40. The replacement opening 5 is an example of a cartridge opening through which ink cartridges are attached are detached.

<Waste Liquid Reservoir of Printer in First Illustrative Embodiment>

The waste liquid reservoir 60 of the printer P in the first illustrative embodiment will now be described in detail. As shown in FIG. 4, the waste liquid reservoir 60 includes a casing 61 disposed in the housing 2, a waste liquid sub-unit 70 which is an example of a first waste liquid reservoir, and a waste liquid unit 80 which is an example of a second waste liquid reservoir. The waste liquid sub-unit 70 and the waste liquid unit 80 are disposed in the casing 61. The waste liquid sub-unit 70 is disposed over the waste liquid unit 80.

The waste liquid unit 80 is movable in the front-rear direction, which is an example of a first direction, between an attached position and a displaced position. The waste liquid unit 80, when at the attached position, is attached to the casing 61. The waste liquid unit 180, when at the displaced position, is displaced toward the front from the attached position. When the cover 22 is at the open position, the replacement opening 5 allows therethrough the waste liquid unit 80 to be inserted into and removed from the casing 61. The replacement opening 5 is an example of an opening. In the first illustrative embodiment, the replacement opening 5 is provided commonly as an opening for inserting and removing ink cartridges relative to the refill unit 40 and as an opening for inserting and removing the waste liquid unit 80 relative to the casing 61. The waste liquid sub-unit 70 is supported by the casing 61 movably in the top-bottom direction which is an example of a second direction.

Figure 5:
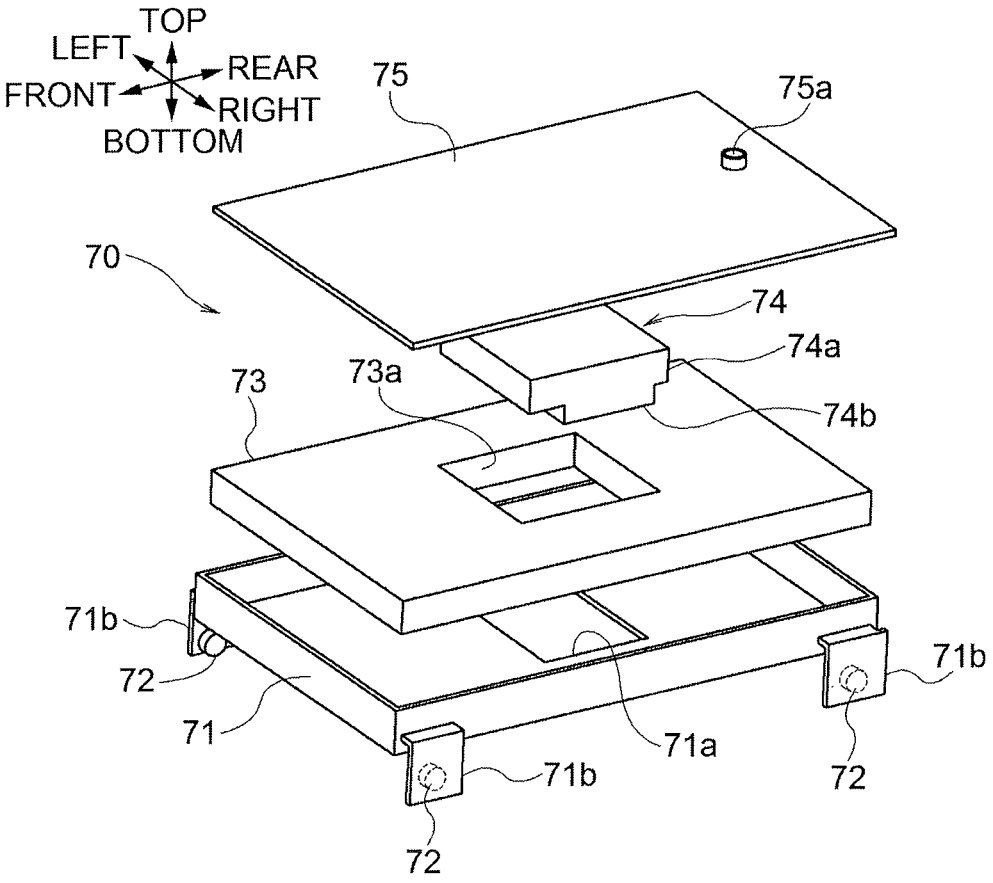
FIG. 5 is a perspective view of a waste liquid sub-unit of the waste liquid reservoir of the printer in the first illustrative embodiment.

As shown in FIG. 5, the waste liquid sub-unit 70 includes a waste liquid sub-case 71, a flat foam member 73, a protruding foam member 74, and a lid 75. The waste liquid sub-case 71 is an example of a first container, and the flat foam member 73 and the protruding foam member 74 are each an example of a first retainer.

The waste liquid sub-case 71 is shaped like a box open upward and has an opening 71*a* at a central portion of its lower face. Four protruding pieces 71*b* protrude downward from front and rear end portions of right and left side faces of the waste liquid sub-case 71. Two bosses 72 protrude toward each other in the right-left direction from respective front right and front left protruding pieces 71*b*. Two bosses 72 protrude toward each other in the right-left direction from respective rear right and rear left protruding pieces 71*b*. Each boss 72 is an example of a protrusion formed in the waste liquid sub-case 71.

The flat foam member 73 has a shape in conformity with an inner space of the waste liquid sub-case 71 and is disposed in the liquid sub-case 71. The flat foam member 73 has a hole 73*a* formed therethrough at its central portion.

The protruding foam member 74 includes a fitted portion 74*a* and a protruding portion 74*b*. The fitted portion 74*a* has a shape in conformity with the shape of the hole 73*a* and is to be fitted into the hole 73*a*. The protruding portion 74*b* protrudes downward from a lower surface of the fitted portion 74*a*. The protruding portion 74*b* has a smaller dimension in the front-rear direction than the fitted portion 74*a* and has a shape in conformity with the opening 71*a*. When the fitted portion 74*a* is fitted in the hole 73*a* of the flat foam member 73 disposed in the waste liquid sub-case 71, the protruding portion 74*b* protrudes beyond the lower face of the waste liquid sub-case 71.

The lid 75 is attached, by welding or the like, to the waste liquid sub-case 71 to shield an upper face of the waste liquid sub-case 71. The lid 75 has a communication hole 75*a* which communicates in and out of the waste liquid sub-case 71. The other end of the tube 56 is connected to the communication hole 75*a*. Ink discharged from the recording head 31 flows, through the tube 56, into the waste liquid sub-case 71 and is absorbed by and retained in the flat foam member 73 and the protruding foam member 74.

Figure 6:
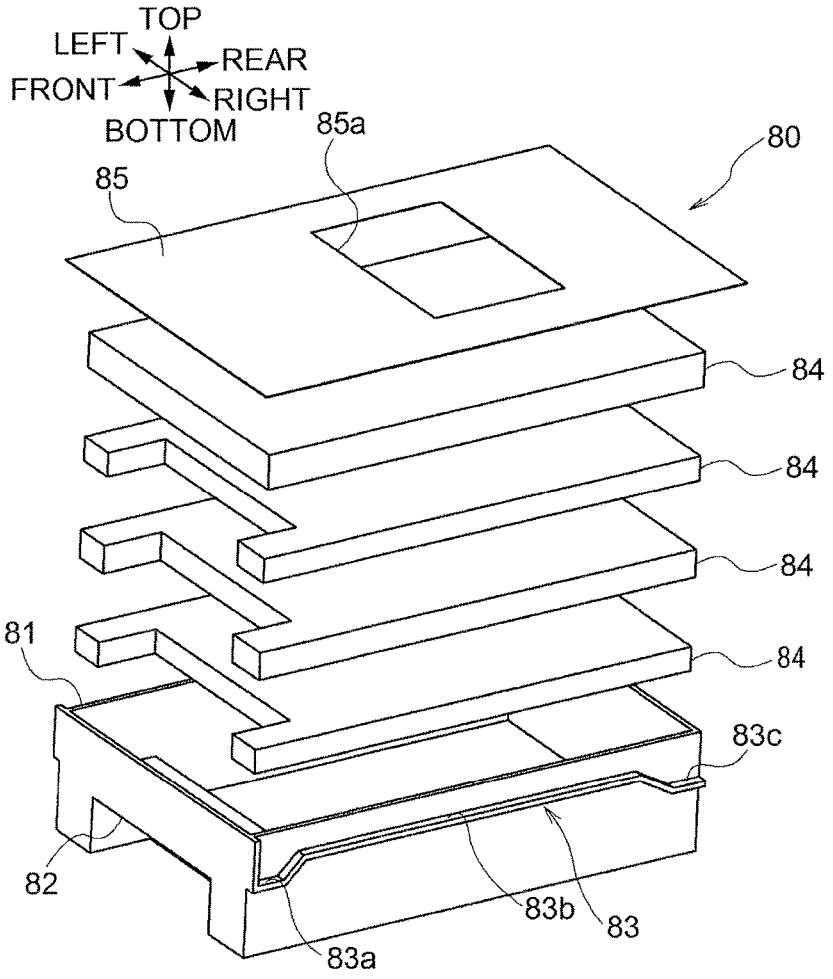
FIG. 6 is a perspective view of a waste liquid unit of the waste liquid reservoir of the printer in the first illustrative embodiment.

As shown in FIG. 6, the waste liquid unit 80 includes a waste liquid case 81, waste liquid foam members 84, and a sealing film 85. The waste liquid case 81 is an example of a second container. The waste liquid foam members 84 are each an example of a second retainer. The sealing film 85 is an example of a lid member. The waste liquid case 81 is shaped like a box open upward. The waste liquid case 81 includes a handle 82 at its front face to allow a user to withdraw the waste liquid unit 80 from the casing 61 by griping the handle 82. Each waste liquid foam member 84 has a thin plate shape and a plurality of liquid foam members are disposed in layers in the waste liquid case 81.

A cam 83 protrudes rightward from a right side face of the waste liquid case 81 and another cam 83 protrudes leftward from a left side face of the waste liquid case 81. Each cam 83 extends in the front-rear direction. The cam 83 has a front end portion 83*a* and a rear end portion 83*c* which are level with each other, and a central portion 83*b* which is above the front end portion 83*a* and the rear end portion 83*c*. An inclined surface, which increases in height toward the rear, interconnects the front end portion 83*a* and the central portion 83*b*, and an inclined surface, which decreases in height toward the rear, interconnects the central portion 83*b* and the rear end portion 83*c*. A cam surface defined by the front end portion 83*a* and the rear end portion 83*c* and a cam surface defined by the central portion 83*a* are offset from each other in the top-bottom direction.

The sealing film 85 is a film member to cover an upper face of the waste liquid case 81 and is attached to the waste liquid case 81 by welding or the like. The sealing film 85 has an opening 85*a* at its central portion. The opening 85*a* has a shape in conformity with the shape of the protruding portion 74*b* and allows the protruding portion 74*b* to enter the waste liquid case 81 therethrough.

When the lower face of the waste liquid sub-unit 70 is placed closer to the upper face of the waste liquid unit 80 such that the protruding portion 74*b* of the protruding foam member 74 enters the waste liquid case 81 through the opening 85*a*, a contact portion of the protruding portion 74*b* and a contact portion of the waste liquid foam member 84 contact each other. Consequently, ink retained by the flat foam member 73 and the protruding foam member 74 moves to the waste liquid foam member 84 through the contact portions and the ink is retained by the waste liquid foam member 84.

In the waste liquid unit 80, the sealing film 85 has the opening 85 through which the protruding portion 74*b* of the protruding foam member 74 contacts the waste liquid foam member 84. The sealing film 85 covers the upper face of the waste liquid case 81 while a relatively small area of the upper face exposed through the opening 85. This may prevent the ink retained by the waste liquid foam member 84 from leaking from the upper face of the waste liquid case 81.

Figure 7:
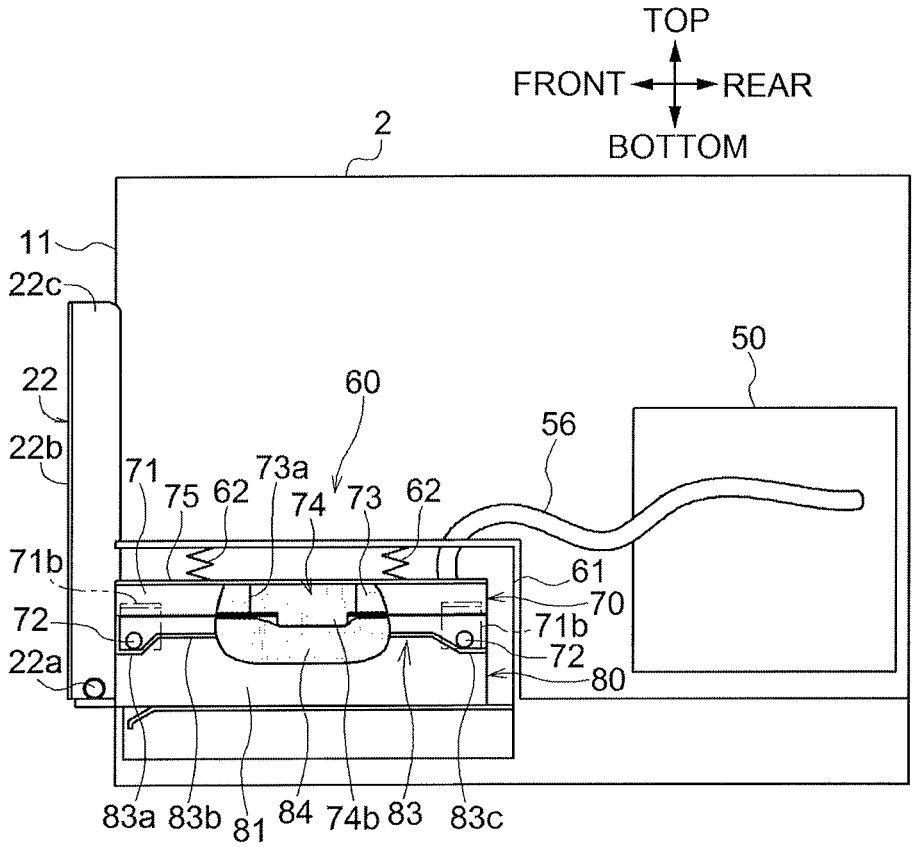
FIG. 7 is a cross-sectional right side view of the waste liquid reservoir of the printer in the first illustrative embodiment, when the waste liquid unit is at an attached position and the waste liquid sub-unit is at a contact position.
Figure 8:
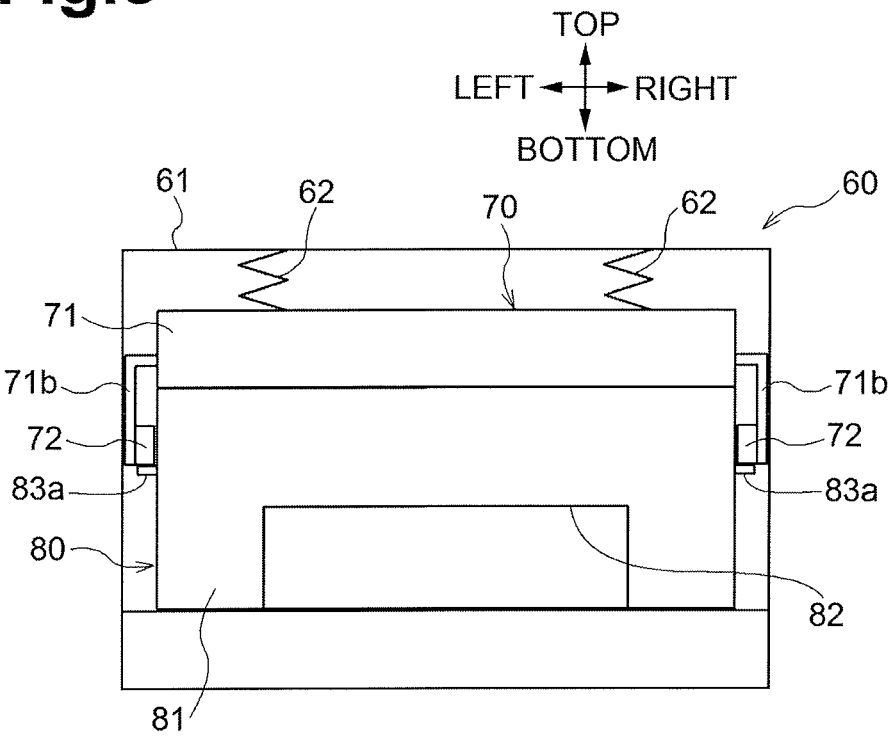
FIG. 8 is a front view of the waste liquid reservoir of the printer in the first illustrative embodiment, when the waste liquid unit is at the attached position and the waste liquid sub-unit is at the contact position.

As shown in FIGS. 7 and 8, in a state where the waste liquid unit 80 is located in the casing 61, the waste liquid sub-unit 70 extends over the waste liquid unit 80, and each boss 72 of the waste liquid sub-unit 70 engages, from above, a corresponding cam 83. More specifically, each boss 72 located at a front end portion on the right or left side of the waste liquid sub-case 71 engages a front end portion 83*a* of a corresponding cam 83, and each boss 72 located at a rear end portion on the right or left side of the waste liquid sub-case 71 engages a rear end portion 83*c* of a corresponding cam 83.

In a case where each boss 72 of the waste liquid sub-case 71 is engaged with a front or rear end portion of a corresponding cam 83, the waste liquid sub-unit 70 is located adjacent to the waste liquid unit 80 and the protruding foam member 74 is in contact with the waste liquid foam member 84. In this case, the protruding portion 74*b* of the protruding foam member 74 protrudes downward into the waste liquid case 81 and is in press-contact with the waste liquid foam member 84.

Because the protruding foam member 74 protrudes from the waste liquid sub-case 71 toward the waste liquid foam member 84, the protruding foam member 74 reliably press-contacts the waste liquid foam member 84. This allows ink to flow smoothly from the flat foam member 73 and the protruding foam member 74 to the waste liquid foam member 84.

Alternatively, the waste liquid foam member 84 may be configured to protrude toward the protruding foam member 74. Still alternatively, the waste liquid foam member 84 may be configured to protrude toward the protruding foam member 74 while the protruding foam member 74 is configured to protrude from the waste liquid sub-case 71 toward the waste liquid foam member 84. In these cases also, the protruding foam member 74 and the waste liquid foam member 84 are reliably in press-contact with each other.

In the first illustrative embodiment, the waste liquid sub-case 71 includes the bosses 72 while the waste liquid case 81 includes the cams 81. Alternatively, the waste liquid case 81 may include the bosses 72 while the waste liquid sub-case 71 may include the cams 83.

Compression springs 62 are disposed between the waste liquid sub-unit 70 and an upper plate of the casing 61 to urge the waste liquid sub-unit 70 downward such that each boss 72 is pressed against a corresponding cam 83. The compression springs 62 are each an example of an urging member which urges the waste liquid sub-unit 70 in the top-bottom direction such that the protruding foam member 74 and the waste liquid foam member 84 press-contact each other. The waste liquid sub-unit 70 is urged by the compression spring 62 in such a direction that the protruding foam member 74 and the waste liquid foam member 84 press-contact each other. This may reliably allow the protruding foam member 74 and the waste liquid foam member 84 to be maintained in a press-contact state.

The waste liquid sub-unit 70 is disposed above the waste liquid unit 80. When ink flows into the waste liquid sub-case 71 from the tube 56, the waste liquid sub-unit 70 increases in weight and exerts an increased load such that the protruding foam member 74 press-contacts the waste liquid foam member 84. This may more reliably allow the protruding foam member 74 and the waste liquid foam member 84 to press-contact each other.

The cam 83 at the right side of the waste liquid case 81 is symmetric, about a centerline in the right-left direction of the waste liquid case 81, to the cam 83 at the left side of the waste liquid case 81. The front and rear bosses 72 at the right side of the waste liquid sub-case 71 are symmetric, about a centerline in the right-left direction of the waste liquid sub-case 71, to the front and rear bosses 72 at the left side of the waste liquid sub-case 71. Given such symmetric configurations, the following description, referring to FIGS. 7 and 9, of the cam 83 at the right side of the waste liquid case 81 and the front and rear bosses 72 at the right side of the waste liquid sub-case 71 applies equally to the cam 83 at the left side of the waste liquid case 81 and the front and rear bosses 72 at the left side of the waste liquid sub-case 71.

Figure 9:
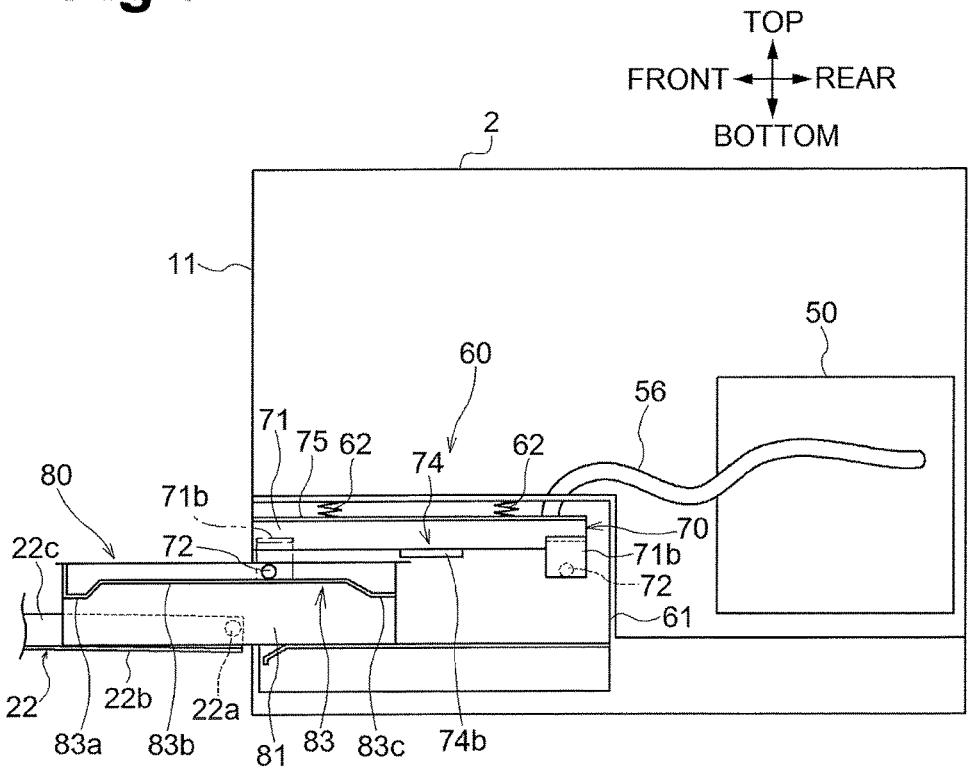
FIG. 9 is a cross-sectional right side view of the waste liquid reservoir of the printer in the first illustrative embodiment, when the waste liquid unit is withdrawn such that the waste liquid sub-unit is at a spaced position.

When the waste liquid unit 80 is moved by horizontally pulling the waste liquid unit 80 frontward, along the casing 61, from a state shown in FIG. 7 where the waste liquid unit 80 is attached to the casing 61, the front boss 72 at the right side of the waste liquid sub-case 71 is released from the front end portion 83*a* of the cam 83 at the right side of the waste liquid case 81 and engages the central portion 83*b* of the cam 83, as shown in FIG. 9.

When the front boss 72 engages the central portion 83*b*, which is located above the front end portion 83*a*, the front boss 72 moves up against an urging force of the compression springs 62. In this case, the rear boss 72 at the right side of the waste liquid sub-case 71 is in a released state from the rear end portion 83*c* of the cam 83.

When the front boss 72 engages the central portion 83*b* to cause the waste liquid sub-unit 70 to move up, the waste liquid sub-unit 70 translates upward without tilting relative to a horizontal plane.

In a state where the front boss 72 is engaged with the central portion 83*b* and the waste liquid sub-unit 70 is raised, a lower end of the protruding portion 74*b* of the protruding foam member 74 is located above an upper end of the waste liquid case 81, and the protruding foam member 74 is spaced apart from the waste liquid foam member 84. This may prevent the protruding foam member 74 from frictionally contacting the waste liquid foam member 84 during frontward movement of the waste liquid unit 80, and thus may reduce surface roughness and deterioration of the protruding foam member 74. In addition, a distance in the top-bottom direction between the front end portion 83*a* and the central portion 83*b* is greater than an entering length in the top-bottom direction of the protruding portion 74*b* into the waste liquid case 81 when the waste liquid unit 80 is attached to the casing 61. This may prevent the sealing film 85 from contacting the protruding portion 74*b* during insertion and removal of the waste liquid unit 80 relative to the casing 61.

As described above, the waste liquid sub-unit 70 is movable in the top-bottom direction between a contact position at which the protruding portion 74*b* of the protruding foam member 74 is in press-contact with the waste liquid foam member 84, and a spaced position at which the protruding portion 74*b* is spaced apart from the waste liquid foam member 84. Also, the waste liquid unit 80 is movable from an attached position at which the waste liquid unit 80 is attached to the casing 61, to a displaced position at which the waste liquid unit 80 is displaced frontward from the attached position.

When the waste liquid sub-unit 56 movable in the top-bottom direction is at the contact position, the front boss 72 of the waste liquid sub-case 71 is engaged with the front end portion 83*a* of the cam 83, and the rear boss 72 of the waste liquid sub-case 71 is engaged with the rear end portion 83*c* of the cam 83. When the waste liquid sub-unit 56 movable in the top-bottom direction is at the spaced position, the front boss 72 of the waste liquid sub-case 71 is engaged with the central portion 83*b* of the cam 83.

When the waste liquid unit 80 movable in the front-rear direction is at the attached position, the front boss 72 of the waste liquid sub-case 71 is engaged with the front end portion 83*a* of the cam 83, and the rear boss 72 of the waste liquid sub-case 71 is engaged with the rear end portion 83*c* of the cam 83. When the waste liquid unit 80 is at the displaced position, the waste liquid unit 80 is displaced frontward from the attached position and the front boss 72 of the waste liquid sub-case 71 is engaged with the central portion 83*b* of the cam 83.

In the waste liquid reservoir 60, the waste liquid sub-unit 70 is at the contact position when the waste liquid unit 80 is at the attached position, and the waste liquid sub-unit 70 is at the spaced position when the waste liquid unit 80 is at the displaced position.

When the waste liquid unit 80 is moved further frontward from a state where the front boss 72 of the waste liquid sub-case 71 is engaged with the central portion 83*b* of the cam 83, the front boss 72 of the waste liquid sub-case 71 engages the rear end portion 83*c* of the cam 83, and then the waste liquid unit 80 is removed entirely from the casing 61. When the front boss 72 is released from the central portion 83*b* and engages the rear end portion 83*c*, the waste liquid sub-unit 70 translates downward.

On the other hand, when the waste liquid unit 80 is inserted into the casing 61 from an exterior of the casing 61, the front boss 72 of the waste liquid sub-case 71 engages the rear end portion 83*c* of the cam 83, and then the waste liquid sub-unit 70 translates upward. When the waste liquid unit 80 is moved rearward from a position shown in FIG. 9 to a position shown in FIG. 7 at which the waste liquid unit 80 is attached to the casing 61, the front boss 72 of the waste liquid sub-case 71 is released from the central portion 83*b* of the right cam 80 and engages the front end portion 83*a* of the cam 83. In this case, the waste liquid sub-unit 70 in a raised state against the urging force of the compression springs 62 moves down by the urging force of the compression springs 62, and the protruding portion 74*b* press-contacts the waste liquid foam member 84.

As describe above, when the waste liquid unit 80 is moved in the front-rear direction between the attached position and the displaced position, the waste liquid sub-unit 70 moves in the top-bottom direction between the contact position and the spaced position but the waste liquid unit 80 does not move in the top-bottom direction. This allows a user to operate the waste liquid unit 80 smoothly with improved operability.

The waste liquid sub-unit 70 translates in the top-bottom direction without tilting relative to the horizontal plane. This may not cause fluctuations of the level of ink retained by the flat foam member 73 and the protruding foam member 74 in the waste liquid sub-case 71 and may prevent leakage of ink from the protruding portion 74*b* of the protruding foam member 74.

As shown in FIG. 9, the waste liquid unit 80 is withdrawn frontward, through the replacement opening 5, from the attached position while the cover 22 is located at the open position. In this case, the waste liquid unit 80 is moved while being supported on the openable plate 22*b* of the cover 22. The openable plate 22 restricts the waste liquid unit 80 from shifting in the top-bottom direction, and the extending portions 22*c* restrict the waste liquid unit 80 from shifting in the right-left direction. Accordingly, the waste liquid unit 80 is moved straight frontward. Reversely, when the waste liquid unit 80 is inserted, the openable plate 22 and the extending portions 22*c* allow the waste liquid unit 80 to be moved straight rearward. The openable plate 22*b* and the extending portions 22*c* of the cover 22 located at the open position function as guide members which guide in the front-rear direction the waste liquid unit 80, when inserted and removed relative to the casing 61.

The replacement opening 5, through which the waste liquid unit 80 is inserted and removed, serves also as an opening through which ink cartridges are inserted and removed relative to the refill unit 40. The replacement opening 5 is formed at the front face 11 of the housing 2, and the front face 11 has a sheet supply/discharge opening 4 through which the sheet cassette 20 is inserted and removed. This front access design allows a user to readily replace the waste liquid unit 80.

<Waste Liquid Reservoir of a Printer in a Second Illustrative Embodiment>

In the waste liquid reservoir 60 of the printer P in the first illustrative embodiment, the waste liquid sub-unit 70 is movable in the top-bottom direction. However, the waste liquid sub-unit 70 may be disposed immovably in the top-bottom direction and the waste liquid unit 80 may be movable in the top-bottom direction.

Figure 10A:
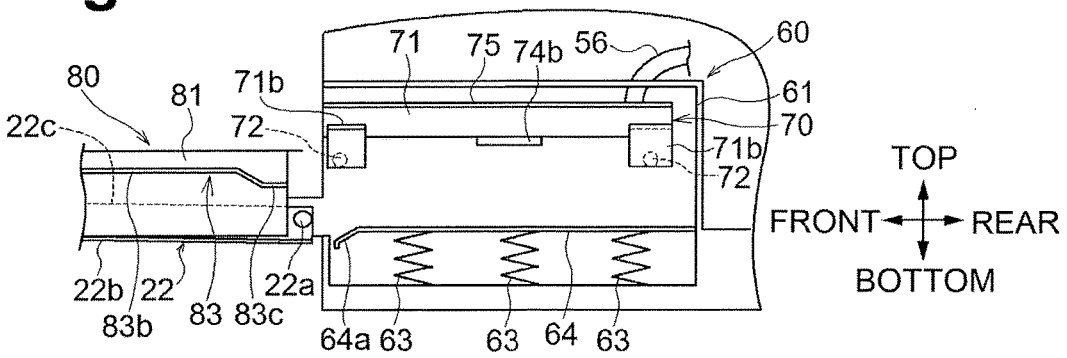
FIGS. 10A to 10D are each a cross-sectional right side view of a waste liquid reservoir of a printer in a second illustrative embodiment, in which a waste liquid sub-unit is immovable in a top-bottom direction and a waste liquid unit is movable in a top-bottom direction.

As shown in FIGS. 10A to 10D, a waste liquid reservoir 60 of a printer P in a second illustrative embodiment includes a support plate 64 disposed in a casing 61 and movable in the top-bottom direction, and compression springs 63 disposed between a bottom plate of the casing 61 and the support plate 64. The compression springs 63 are each an example of an urging member. As shown in FIG. 10A, an upper surface of the support plate 64 is located above an openable plate 22*b* of a cover 22 located at an open position. The support plate 64 includes, at its front end portion, an inclined surface 64*a* which is inclined downward toward the front. A front end of the inclined surface 64*a* is level with the openable plate 22*b*.

The waste liquid sub-unit 70 is supported by the casing 61 immovably in the top-bottom direction. The waste liquid unit 80 is insertable and removable relative to the casing 61 through a replacement opening 5. The waste liquid sub-unit 70 and the waste liquid unit 80 have the same or similar configurations to those in the first illustrative embodiment, a redundant description thereof will be omitted. The following description, referring to FIGS. 10A to 10D, of a cam 83 at a right side of a waste liquid unit 80 and front and rear bosses 72 at a right side of a waste liquid sub-unit 70 applies equally to a cam 83 at a left side of the waste liquid unit 80 and front and rear bosses 72 at a left side of the waste liquid sub-unit 70.

Figure 10B:
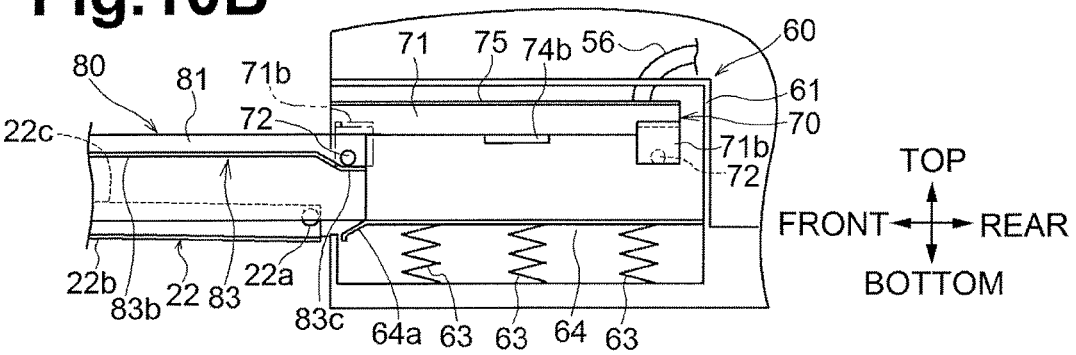

As shown in FIG. 10A, when the waste liquid unit 80, once removed from the casing 61, is inserted through the replacement opening 5 into the casing 61, a rear end portion at the right side of the waste liquid unit 80 is placed on a front end portion of the support plate 64, and the waste liquid unit 80 is urged upward by the compression springs 63, as shown in FIG. 10B. In this state shown in FIG. 10B, the waste liquid unit 80 is located adjacent, in the top-button direction, to the waste liquid sub-unit 70 while a rear end portion 83*c* of a cam 83 at the right side of the waste liquid unit 80 is in contact with a front boss 72 at the right side of the waste liquid sub-case 71.

Figure 10C:
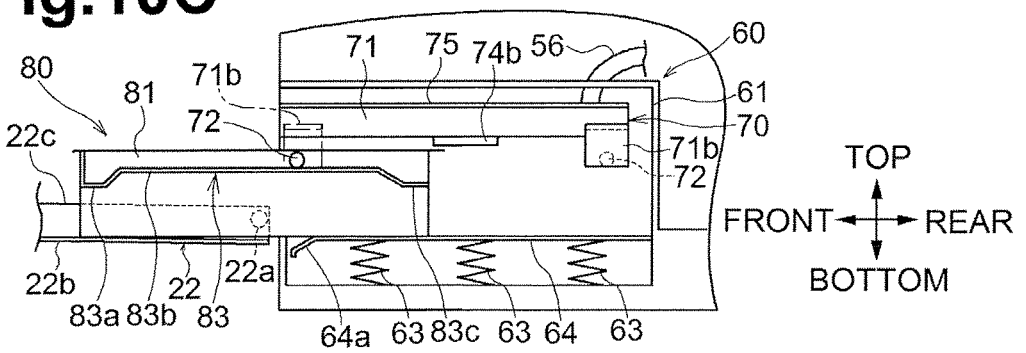

When the waste liquid unit 80 is inserted further into the casing 61, a central portion 83*b* of the cam 83 of the waste liquid unit 80, instead of the rear end portion 83*c*, contacts the front boss 72, and the waste liquid unit 80 is pushed down against the urging force of the compression springs 63, as shown in FIG. 10C.

In a state shown in FIG. 10C, the waste liquid unit 80 is further spaced apart, in the top-bottom direction, from the waste liquid sub-unit 70 than in a state shown in FIG. 10B. In this case, a lower end of a protruding portion 74*b* of a protruding foam member 74 is located above an upper end of a waste liquid case 81, and the protruding foam member 74 and a waste liquid foam member 84 are spaced apart from each other in the top-bottom direction. This may prevent the protruding foam member 74 from frictionally contact the waste liquid foam member 84 during insertion of the waste liquid unit 80 into the casing 61, and thus may reduce surface roughness and deterioration of the protruding foam member 74 and the waste liquid foam member 84.

When the waste liquid unit 80 is inserted further into the casing 61 from the state shown in FIG. 10C, a front end portion 83*a* of the cam 83 of the waste liquid unit 80, instead of the central portion 83*b*, contacts the front boss 72, and the waste liquid unit 80 moves up by the urging force of the compression springs 63. The waste liquid unit 80 moves closer to the waste liquid sub-unit 70, and the protruding foam member 74 and the waste liquid foam member 84 press-contact each other.

Figure 10D:
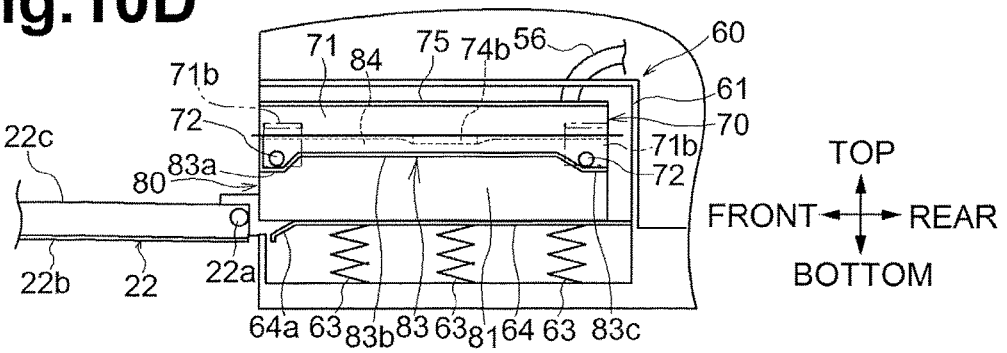

In contrast, when the waste liquid unit 80 is moved frontward from a state shown in FIG. 10D where the waste liquid unit 80 is attached the casing 61 to a position shown in FIG. 10C, the rear boss 72 of the waste liquid sub-case 71 is released from the rear end portion 83*c* of the cam 83, and the front boss 72 engages the central portion of the right cam 83. In this case, the waste liquid unit 80 in a raised state by the urging force of the compression springs 62 moves down against the urging force of the compression springs 62 such that the protruding portion 74*b* and the waste liquid foam member 84 is spaced apart from each other. When the waste liquid unit 80 is moved further frontward, the front boss 72 of the waste liquid sub-case 71 engages the rear end portion 83*c* of the right cam 83, as shown in FIG. 10B. In this case, the waste liquid unit 80 moves up. The waste liquid unit 80, when moved still further frontward, is entirely removed from the casing 61.

As described above, in the waste liquid reservoir 60 of the printer P in the second illustrative embodiment, the waste liquid unit 80 is movable in the top-bottom direction between the contact position at which the protruding portion 74*b* of the protruding foam member 74 and the waste liquid foam member 84 are in press-contact with each other, and the spaced position at which the protruding portion 74*b* and the waste liquid member 84 are spaced apart from each other. In the second illustrative embodiment also, the waste liquid unit 80 is movable between the attached position at which the waste liquid unit 80 is attached to the casing 61 and a displaced position at which the waste liquid unit 80 is displaced frontward from the attached position.

When the waste liquid unit 80 movable in the top-bottom direction is at the contact position, the front boss 72 of the waste liquid sub-case 71 is engaged with the front end portion 83*a* of the cam 83, and the rear boss 72 of the waste liquid sub-case 71 is engaged with the rear end portion 83*c* of the cam 83. When the waste liquid unit 80 movable in the top-bottom direction is at the spaced position, the front boss 72 of the waste liquid sub-case 71 is engaged with the central portion 83*b* of the cam 83.

When the waste liquid unit 80 movable in the front-rear direction is at the attached position, the front boss 72 of the waste liquid sub-case 71 is engaged with the front end portion 83*a* of the cam 83, and the rear boss 72 of the waste liquid sub-case 71 is engaged with the rear end portion 83*c* of the cam 83. When the waste liquid unit 80 movable in the front-left direction is at the displaced position, the front boss 72 of the waste liquid sub-case 71 is engaged with the central portion 83*b* of the cam 83.

In the waste liquid reservoir 60 of the printer P in the second illustrative embodiment, the waste liquid unit 80 is located at the contact position when the waste liquid unit 80 is at the attached position, and located at the spaced position when the waste liquid unit 80 is at the displaced position.

<Waste Liquid Reservoir of a Printer in a Third Illustrative Embodiment>

In the waste liquid reservoir 60 of the printer P in the first and second illustrative embodiment, the waste liquid unit 80 is insertable and removable in the front-rear direction. However, the waste liquid unit 80 may be insertable and removable in the top-bottom direction.

In a waste liquid reservoir 60 of an printer P in a third illustrative embodiment, a waste liquid sub-unit 70 and a waste liquid unit 80 may be disposed in a casing 61 side by side in the right-left direction. The waste liquid sub-unit 70 may be movable in the right-left direction while the waste liquid unit 80 may be movable in the top-bottom direction so as to be inserted and removed in the top-bottom direction relative to a top or bottom face of a housing 2.

In this case, the waste liquid sub-unit 70 is movable in the right-left direction between a contact position at which a protruding portion 74*b* of a protruding foam member 74 and a waste liquid foam member 84 are in press-contact with each other, and a spaced position at which the protruding portion 74*b* is spaced apart from the waste liquid foam member 84. The waste liquid unit 80 is movable between an attached position at which the waste liquid unit 80 is attached to the casing 61, and a displaced position at which the waste liquid unit 80 is displaced upward or downward from the attached position. The waste liquid sub-unit 70 is located at the contact position when the waste liquid unit 80 is at the attached position, and located at the spaced position when the waste liquid unit 80 is at the displaced position.

Alternatively, when the waste liquid unit 80 is configured to be inserted and withdrawn in the top-bottom direction, the waste liquid sub-unit 70 may be disposed immovably in the right-left direction while the waste liquid unit 80 is configured to move in the top-bottom direction and in the right-left direction. The waste liquid unit 80, when at the attached position, may be configured to be located at the contact position and, when at the displaced position, may be configured to be located at the spaced position.

<Waste Liquid Reservoir of a Printer in a Fourth Illustrative Embodiment>

In a waste liquid reservoir 60 of a printer P in a fourth illustrative embodiment, a waste liquid unit 80 may be configured to be inserted and removed in the right-left direction relative to a right or left side face of a housing 2. In this case, the waste liquid sub-unit 70 is movable in the to-bottom direction between a contact position at which a protruding portion 74*b* of a protruding foam member 74 and a waste liquid foam member 84 are in press-contact with each other, and a spaced position at which the protruding portion 74*b* and the waste liquid foam member 84 are spaced apart from each other. The waste liquid unit 80 is movable between an attached position at which the waste liquid unit 80 is attached to a casing 61, and a displaced position at which the waste liquid unit 80 is displaced rightward or leftward from the attached position. The waste liquid sub-unit 70 is located at the contact position when the waste liquid unit 80 is at the attached position, and located at the spaced position when the waste liquid unit 80 is at the displaced position.

Alternatively, when the waste liquid unit 80 is configured to be inserted and withdrawn in the right-left direction, the waste liquid sub-unit 70 may be disposed immovably in the top-left direction and the waste liquid unit 80 may be movable in the right-left direction and in the top-bottom direction. The waste liquid unit 80, when at the attached position, may located at the contact position and, when at the displaced position, may be located at the spaced position.

<Waste Liquid Reservoir of a Printer in a Fifth Illustrative Embodiment>

Figure 11A:
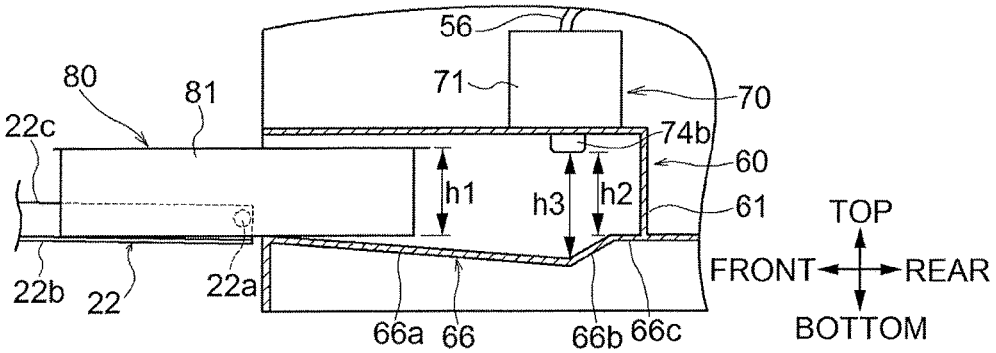
FIGS. 11A to 11C are each a cross-sectional right side view of a waste liquid reservoir of a printer in another illustrative embodiment, in which a waste liquid sub-unit is immovable in the top-bottom direction and a waste liquid unit is movable in the top-bottom direction.
Figure 11B:
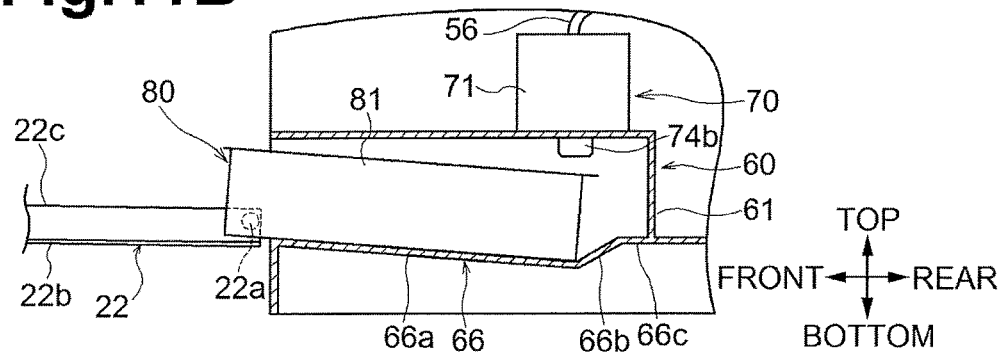
Figure 11C:
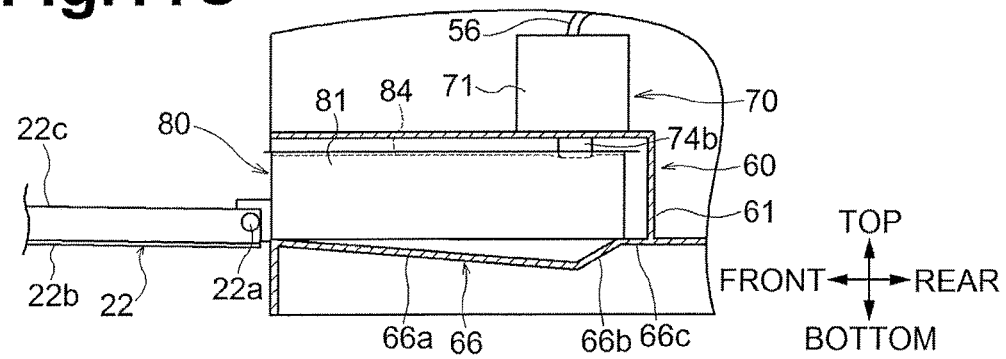

As shown in FIGS. 11A-11C, in a waste liquid reservoir 60 of a printer P in a fifth illustrative embodiment, a waste liquid sub-unit 70 is disposed immovably in the top-bottom direction, and a waste liquid unit 80, which is inserted and removed in the front-rear direction, is movable in the top-bottom direction.

In the waste liquid reservoir shown in FIG. 11, the waste liquid sub-unit 70 is fixed to an upper face 65 of a casing 61. A protruding portion 74*b* of a protruding foam member 74 protrudes into a rear portion of the casing 61. In this embodiment, the waste liquid sub-unit 70 includes no protruding pieces or no bosses, and the waste liquid unit 80 includes no cams.

In the fifth embodiment, a bottom plate 66 of the casing 61 has a first inclined surface 66*a*, a second inclined surface 66*b*, and a horizontal surface 66*c*. The first inclined surface extends from a front end of the casing 61 and is inclined downward toward a rear end of the casing 61. The second inclined surface 66*b* extends from the rear end of the first inclined surface 66*a* and is inclined upward toward the rear end of the casing 61. The horizontal surface 66*c* extends from the rear end of the second inclined surface 66*b* to the rear end of the casing 61.

A front end of the first inclined surface 66*a* is level with the horizontal surface 66*c*. A vertical dimension h2 between the horizontal surface 66*c* (or the front end of the first inclined surface 66*a*) and a lower end of the protruding portion 74*b* of the protruding foam member 74 is less than a vertical dimension h1 of the waste liquid unit 80. A joint between the first inclined surface 66*a* and the second inclined surface 66*b* is located below the front end of the first inclined surface 66*a* and the horizontal surface 66*c*. A vertical dimension h3 between the joint and the lower end of the protruding portion 74*b* is set to be greater than the vertical dimension h1 of the waste liquid unit 80.

In thus configured waste liquid reservoir 60, as shown in FIG. 11A, when the waste liquid unit 80, once removed from the casing 61 is moved rearward such that its rear end portion is inserted from the replacement opening 5 into the casing 61, the waste liquid unit 80 moves obliquely downward along the inclined surface 66*a*.

As shown in FIG. 11B, when the rear end of the waste liquid unit 80 moving rearward reaches the joint between the first inclined surface 66*a* and the second inclined surface 66*b*, the rear end of the waste liquid unit 80 is spaced apart, in the top-bottom direction, from the lower end of the protruding portion 74*b* because the vertical dimension h3 is greater than the vertical dimension h1. This may prevent the rear end of the waste liquid unit 80 from frictionally contacting the protruding foam member 74 and thus may reduce surface roughness and deterioration of the protruding foam member 74.

When the waste liquid unit 80 is moved further rearward from a state shown in FIG. 11B, the rear end of the waste liquid unit 80 moves upward and rearward along the second inclined surface 66*b*. When the rear end of the waste liquid unit 80 reaches the rear end portion of the casing 61, the rear end of the waste liquid unit 80 moves onto the horizontal surface 66*c*, and the waste liquid unit 80 moves into an attached position. When the rear end of the waste liquid unit 80 moves on the horizontal surface 66*c*, the protruding portion 74*b* of the protruding foam member 74 enters the waste liquid case 81 to press-contact the waste liquid foam member 84.

On the other hand, when the waste liquid unit 80 is moved frontward from the attached position shown in FIG. 11C to a position shown in FIG. 11B, the rear end of the waste liquid unit 80 moves away from the horizontal surface 66*c* to the joint between the first inclined surface 66*a* and the second inclined surface 66*b*. In this case, the protruding portion 74 and the waste liquid foam member 74 are released and spaced from each other. When the waste liquid unit 80 is moved further frontward, the waste liquid unit 80 moves obliquely upward and is withdrawn from the casing 61.

In each of the above-described illustrative embodiments, this fifth illustrative embodiment, the waste liquid unit 80 is movable in the front-rear direction between the attached position at which the rear end of the waste liquid unit 80 is located on the horizontal surface 66*c*, and a displaced position at which the rear end of the waste liquid unit 80 is located at the joint between the first inclined surface 66*a* and the second inclined surface 66*b*. The waste liquid unit 80 is movable also in the top-bottom direction between a contact position at which the rear end of the waste liquid unit 80 is located on the horizontal surface 66*c*, and a spaced position at which the rear end of the waste liquid unit 80 is located at the joint between the first inclined surface 66*a* and the second inclined surface 66*b*.

<Effects>

In each of the above-described illustrative embodiments, at least one of the contact portion of the protruding foam member 74 and the contact portion of the waste liquid foam member 84 is configured to protrude from corresponding at least one of the waste liquid sub-case 71 and the waste liquid case 81 in a direction perpendicular to a direction in which the waste liquid unit is inserted and removed relative to the housing 2.

With this configuration, the protruding foam member 74 and the waste liquid foam member 84 reliably contact each other, thereby allowing ink to be conveyed smoothly from the protruding foam member 74 to the waste liquid foam member 84.

The waste liquid unit 80 including the waste liquid foam member 84 is removable from the housing 2 and replaceable with a new one. This may prolong the service life of the waste liquid reservoir 60.

While the disclosure has been described in detail with reference to the specific embodiments, various changes, arrangements and modifications may be applied therein without departing from the spirit and scope of the disclosure.

What is claimed is:

1. A liquid ejection apparatus comprising:

a housing;

a head configured to eject liquid;

a passage member configured to convey therethrough liquid discharged from the head;

a first waste liquid reservoir disposed in the housing and including:

a first container connected to the passage member; and a first retainer having a first contact portion and disposed in the first container, the first retainer being configured to retain the liquid conveyed through the passage member; and a second waste liquid reservoir disposed in the housing and including:

a second container; and a second retainer having a second contact portion and disposed in the second container such that the second contact portion is in contact with the first contact portion of the first retainer, the second retainer being configured to retain the liquid conveyed through the passage member, wherein the second waste liquid reservoir is movable in a first direction, and one of the first waste liquid reservoir and the second waste liquid reservoir is movable in a second direction perpendicular to the first direction, wherein at least one of the first retainer and the second retainer protrudes in the second direction from corresponding at least one of the first container and the second container, and wherein the second waste liquid reservoir is movable in the first direction from an attached position at which the second waste liquid reservoir is attached to the housing, and the second retainer is spaced apart from the first retainer unless the waste liquid reservoir is located at the attached position.

2. The liquid ejection apparatus according to claim 1, further comprising an urging member, wherein the first waste liquid reservoir is movable in the second direction, and the urging member is configured to urge the first waste liquid reservoir toward the second waste liquid reservoir.

3. The liquid ejection apparatus according to claim 2, wherein the first waste liquid reservoir is disposed over the second waste liquid reservoir.

4. The liquid ejection apparatus according to claim 3, wherein the first waste liquid reservoir is configured to move in the second direction without tilting relative to the first direction.

5. The liquid ejection apparatus according to claim 1, further comprising an urging member, wherein the second waste liquid reservoir is movable in the second direction, and the urging member is configured to urge the second waste liquid reservoir toward the first waste liquid reservoir.

6. The liquid ejection apparatus according to claim 1, wherein one of the first container and the second container includes a cam extending in the first direction and having a first cam surface and a second cam surface which are offset from each other in the second direction, wherein the other of the first container and the second container includes a protrusion configured to engage the first cam surface and the second cam surface.

7. The liquid ejection apparatus according to claim 6, wherein the first retainer is configured to:

when the protrusion is engaged with the first cam surface, protrude in the second direction from the first container and enter the second container by an entering length which is less than a distance between the first cam surface and a second cam surface in the second direction; and when the protrusion is engaged with the second cam surface, be spaced apart from the second container.

8. The liquid ejection apparatus according to claim 1, wherein the second container includes a lid member facing the first container, the lid member having an opening through which the second contact portion of the second retainer contacts the first contact portion of the first retainer.

9. The liquid ejection apparatus according to claim 1, wherein the housing is configured to house therein a liquid cartridge storing liquid to be supplied to the head, the housing including a particular face which has a cartridge opening through which the liquid cartridge is inserted and removed relative to the housing in the first direction, and a reservoir opening through which the second waste liquid reservoir is inserted and removed relative to the housing.

10. The liquid ejection apparatus according to claim 1, wherein the housing is configured to house therein a sheet cassette configured to hold a sheet for receiving the liquid ejected by the head, the housing including a particular face which has a cassette opening through which the sheet cassette is inserted and removed relative to the housing in the first direction, and a reservoir opening through which the second waste liquid reservoir is inserted and removed relative to the housing.

11. The liquid ejection apparatus according to claim 1, wherein an entirety of the one of the first waste liquid reservoir and the second waste liquid reservoir is movable in the second direction.

12. A liquid ejection apparatus comprising:

a housing;

a head configured to eject liquid;

a passage member configured to convey therethrough liquid discharged from the head;

a first waste liquid reservoir disposed in the housing and including:

a first container connected to the passage member; and a first retainer having a first contact portion and disposed in the first container, the first retainer being configured to retain the liquid conveyed through the passage member; and a second waste liquid reservoir disposed in the housing and including:

a second container; and a second retainer having a second contact portion and disposed in the second container such that the second contact portion is in contact with the first contact portion of the first retainer, the second retainer being configured to retain the liquid conveyed through the passage member, wherein the second waste liquid reservoir is movable in a first direction, and one of the first waste liquid reservoir and the second waste liquid reservoir is movable in a second direction perpendicular to the first direction, wherein at least one of the first retainer and the second retainer protrudes in the second direction from corresponding at least one of the first container and the second container, wherein the second waste liquid reservoir is movable between an attached position at which the second waste liquid reservoir is attached to the housing, and a displaced position at which the second waste liquid reservoir is displaced from the attached position in the first direction, and wherein the one of the first waste liquid reservoir and the second waste liquid reservoir is movable in the second direction between a contact position at which the first contact portion of the first retainer and the second contact portion of the second retainer are in press-contact with each other, and a spaced position at which the first retainer and the second retainer are spaced apart from each other, the one of the first waste liquid reservoir and the second waste liquid reservoir being configured to be located at the contact position when the second waste liquid reservoir is located at the attached position, and to be located at the spaced position when the second waste liquid reservoir is located at the displaced position.

13. A liquid ejection apparatus comprising:

a housing;

a head configured to eject liquid;

a passage member configured to convey therethrough liquid discharged from the head;

a first waste liquid reservoir disposed in the housing and including:

a first container connected to the passage member; and a first retainer having a first contact portion and disposed in the first container, the first retainer being configured to retain the liquid conveyed through the passage member; and a second waste liquid reservoir disposed in the housing and including:

a second container; and a second retainer having a second contact portion and disposed in the second container such that the second contact portion is in contact with the first contact portion of the first retainer, the second retainer being configured to retain the liquid conveyed through the passage member, wherein the second waste liquid reservoir is movable in a first direction, and one of the first waste liquid reservoir and the second waste liquid reservoir is movable in a second direction perpendicular to the first direction, wherein at least one of the first retainer and the second retainer protrudes in the second direction from corresponding at least one of the first container and the second container, and wherein the housing includes a cover pivotable, at a lower end thereof, between an open position at which the cover defines a reservoir opening, and a closed position at which the cover covers the second waste liquid reservoir, the cover including a guide member configured to, when the cover is at the open position, guide the second waste liquid reservoir through the reservoir opening in the first direction which is a horizontal direction.

* * * * *